US008517340B2

(12) United States Patent
Pell

(10) Patent No.: US 8,517,340 B2
(45) Date of Patent: Aug. 27, 2013

(54) APPARATUS FOR PUSHING A FASTENER FROM A HOST MATERIAL

(75) Inventor: James Douglas Pell, Wimberly, TX (US)

(73) Assignee: Mayhew Steel Products, Inc., Turners Falls, MA (US)

( * ) Notice: Subject to any disclaimer, the term of this patent is extended or adjusted under 35 U.S.C. 154(b) by 70 days.

(21) Appl. No.: 13/290,780

(22) Filed: Nov. 7, 2011

(65) Prior Publication Data

US 2012/0138879 A1 Jun. 7, 2012

Related U.S. Application Data

(60) Provisional application No. 61/456,396, filed on Nov. 5, 2010, provisional application No. 61/499,206, filed on Jun. 21, 2011.

(51) Int. Cl.
*B25C 11/00* (2006.01)
*B66F 15/00* (2006.01)

(52) U.S. Cl.
USPC ..... 254/18; 254/28; 227/63

(58) Field of Classification Search
USPC ..... 254/18, 28; 227/11, 63, 114, 119, 227/147; 81/45
See application file for complete search history.

(56) References Cited

U.S. PATENT DOCUMENTS

| | | | | | |
|---|---|---|---|---|---|
| 843,655 | A | * | 2/1907 | Adell | 30/367 |
| 1,572,046 | A | * | 2/1926 | Seiler | 30/367 |
| 2,384,707 | A | * | 9/1945 | Sweet | 30/367 |
| 2,594,901 | A | * | 4/1952 | Forster | 173/31 |
| 3,172,204 | A | * | 3/1965 | Frey | 30/367 |
| 3,177,952 | A | * | 4/1965 | West | 173/121 |
| 3,279,044 | A | * | 10/1966 | Roper | 29/739 |
| 4,682,412 | A | * | 7/1987 | Pfeffer | 29/750 |
| 5,141,205 | A | | 8/1992 | Iwai et al. | |
| 5,282,564 | A | * | 2/1994 | Vigil Rio | 227/14 |
| 5,904,284 | A | * | 5/1999 | Lin | 227/11 |

* cited by examiner

*Primary Examiner* — Lee D Wilson
*Assistant Examiner* — Alvin Grant
(74) *Attorney, Agent, or Firm* — O'Shea Getz P.C.

(57) ABSTRACT

An apparatus for pushing a fastener from a host material with, for example, an air hammer includes a punch shank, a compression spring, a hollow sleeve, a fastener and a punch. The hollow sleeve includes an opening formed therein for interfitment over a central portion of the punch shank, and a set screw placed therein for engagement with a retention flat portion of a central portion of the punch shank. The punch includes a top that operably engages with the air hammer, and a bottom end having a recess formed therein, where the recess is configured and arranged for retention of a top of the punch shank. The spring fits over the punch shank, and contacts the bottom end of the punch and the top end of the sleeve.

6 Claims, 17 Drawing Sheets

APPARATUS FOR PUSHING A FASTENER FROM A HOST MATERIAL

PRIORITY INFORMATION

This application claims priority under 35 U.S.C. §119(e) from U.S. provisional patent application Ser. No. 61/456,396 filed Nov. 5, 2010 and from U.S. provisional patent application Ser. No. 61/499,206 filed Jun. 21, 2011, both of which are hereby incorporated by reference.

BACKGROUND OF THE INVENTION

The present invention relates to the fields of hand tools and power tools, and in particular to hand tools for removing fasteners from a host material, such as for example wood, and power tools for removing fasteners from a host material.

Removing nails from used lumber for reuse of the lumber is a tedious and time consuming task. U.S. Pat. No. 5,141,205 discloses a pneumatic nail remover.

However, there is a need for an improved device for removing fasteners from a host material, and in particular to removing nails from wood.

SUMMARY OF THE INVENTION

An apparatus for pushing a fastener from a host material with an air hammer includes a punch shank having a top, a bottom and a central portion that includes a retention flat formed therein. The apparatus also includes a hollow sleeve having a top end and a tapered bottom end, where the sleeve includes an opening formed therein for interfitment over the central portion of the punch shank and a set screw placed therein for engagement with the retention flat portion of the punch shank. The apparatus also includes a punch and a spring. The punch comprises a top that operably engages with the air hammer and a bottom end having a recess formed therein, where the recess is configured and arranged for retention of the top of the punch shank The spring fits over the punch shank, and contacts the bottom of the punch and the top end of the sleeve. Repeated rapid pulsations from the air hammer against the punch and against the restoration force of the spring in response to activating the air hammer causes repeated movement of the punch shank through the sleeve to push a fastener from a host material.

Advantageously, the apparatus can be configured to push out a variety of fasteners of various sizes. If a nail head or a staple crown is embedded in the host material the apparatus will finesse or manipulate the fastener with the vibrating action created by the air hammer The apparatus can dig out and straighten a fastener such as a nail that has been bent and hammered down parallel to the board face. By placing the tapered edge of the sleeve at an angle against the nail point with slight force and pulsing the air hammer trigger the spring load on the sleeve along with the vibration of the hammer will jar the nail point away from the face enough to begin slipping the sleeve over the nail and start the process of pushing it out.

The apparatus may also be used as a nail driver. By placing the nail head in the hollow sleeve and the nail point at the chosen point of entry into the host material, applying a relatively small amount of pressure while activating the air hammer the nail will be driven in place. The apparatus will drive used and slightly bent nails and will reach hard to access places overhead or in tight areas.

These and other objects, features and advantages of the present invention will become more apparent in light of the following detailed description of preferred embodiments thereof, as illustrated in the accompanying drawings.

BRIEF DESCRIPTION OF THE DRAWING

FIG. 3A illustrates the punch of the apparatus shown in FIG. 1, while

FIG. 15A illustrates an embodiment of the hand tool suitable for use with the strike of an open palm or force applied by the hand of the user, while

DESCRIPTION OF THE INVENTION

Figure 1:
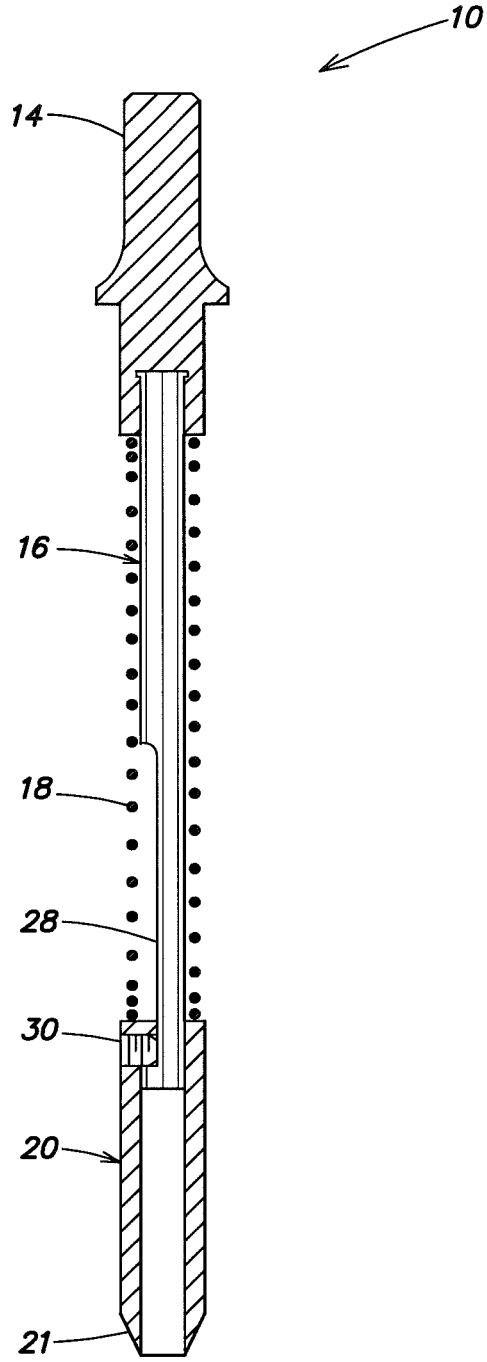
FIG. 1 is a cross sectional illustration of a first embodiment of an apparatus for pushing a fastener from a host material.
Figure 2:
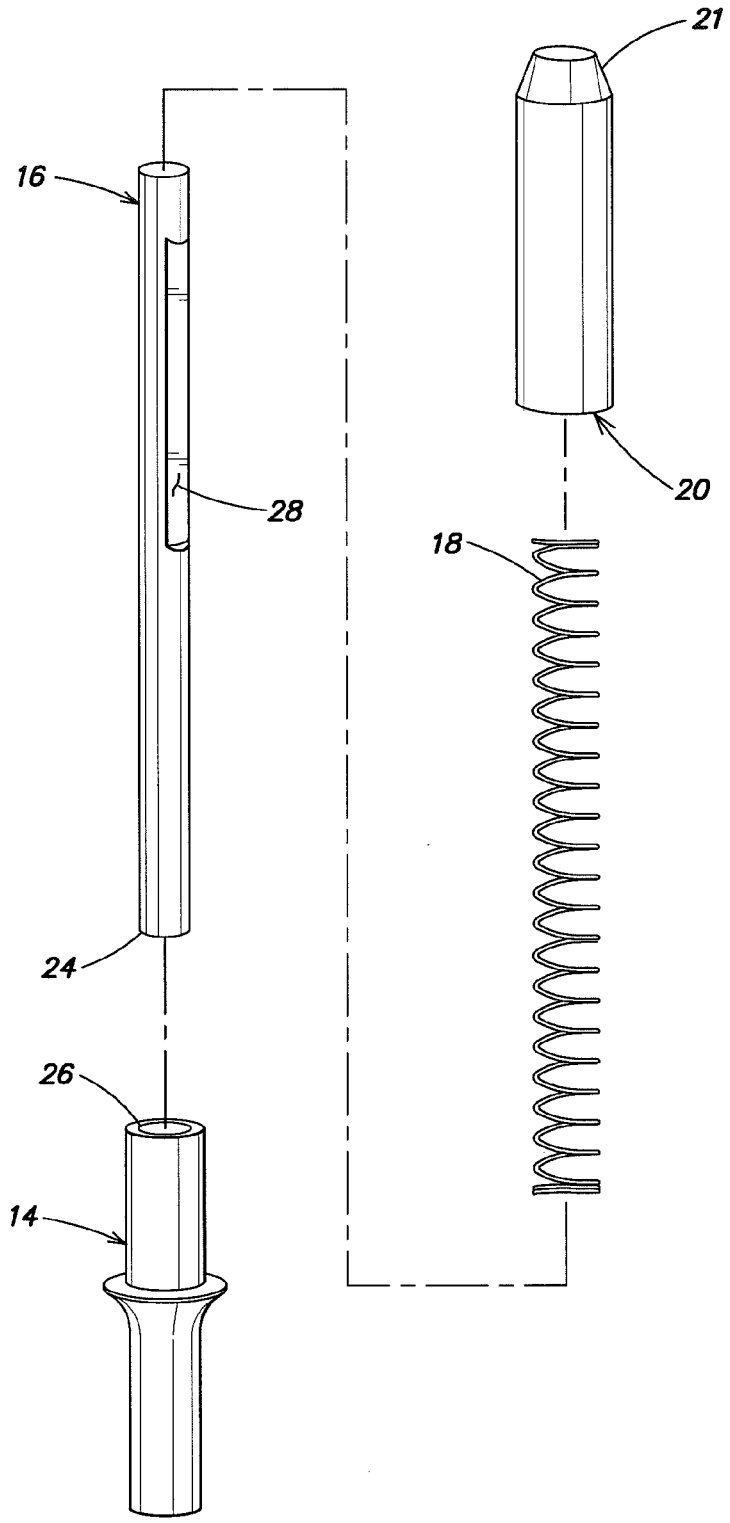
FIG. 2 is an exploded view of several components of the apparatus illustrated in FIG. 1.

FIG. 1 is a cross sectional illustration of a first embodiment of an apparatus 10 for pushing a fastener from a host material. FIG. 2 is an exploded view of several components of the apparatus illustrated in FIG. 1. Referring to FIGS. 1 and 2, the apparatus includes a punch 14, such as for example a 0.401 inch parker taper air hammer punch, a punch shank 16, a compression spring 18 and a hollow sleeve 20 with a distal exterior radial sidewall 21. The compression spring 18 is installed over the shank 16, and the sleeve 20 is then installed over a distal end of the shank 16 under tension while the setscrew 30 is tightened into a retention flat 28 of the shank to keep the sleeve 20 retained. The set screw 30 preferably has a relatively flat head to longitudinally slide along the retention flat 28.

Figure 3A:
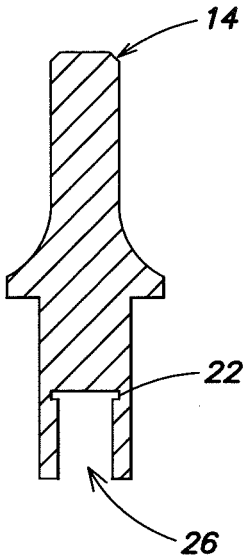

FIGS. 3A illustrates the punch 14 of the apparatus shown in FIG. 1. The punch 14 includes a recess 26, which may be for example in one embodiment drilled 0.3125 inch wide×0.500 inch deep. An internal retaining ring style groove 22 may be cut in the bottom of the recess 26.

Figure 3B:
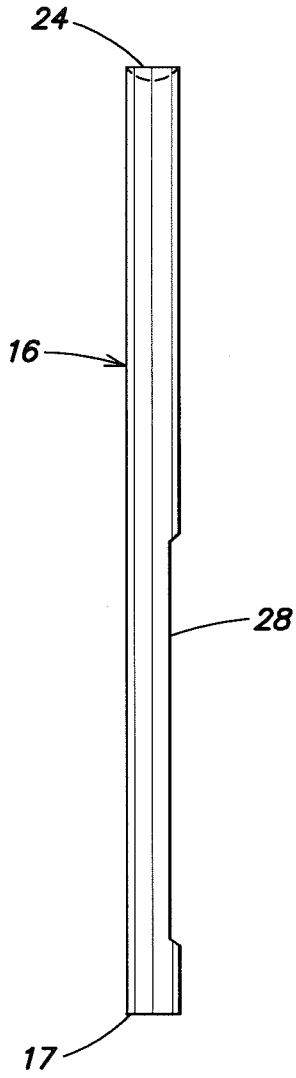
FIG. 3B illustrates the punch shank of the apparatus illustrated in FIG. 1.

FIG. 3B illustrates the punch shank 16 of the apparatus illustrated in FIG. 1. The punch shank may be machined at its proximal end 24 to have a concave head. The end 24 is inserted into the recess 26 (FIG. 3A), and when given one or more sharp hammer blows the radial edges of the concave end 24 flare into the groove 22 (FIG. 3A), thus securing the shank 16 to the punch 14. The punch also includes a distal end 17. The proximal end may be heated immediately prior to insertion to the recess to facilitate spreading of the proximal end into the groove 22 (FIG. 3A).

Figure 4:
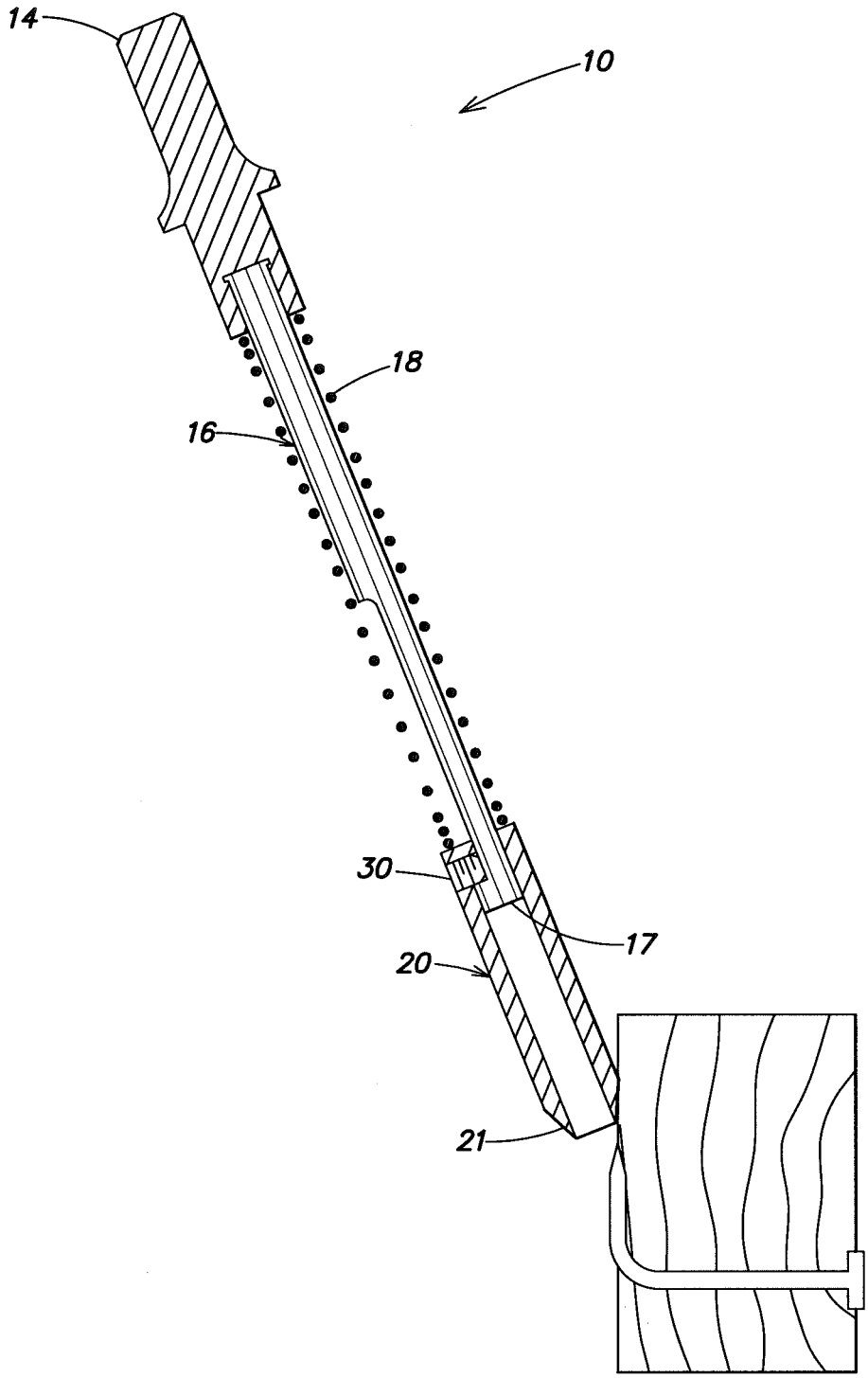
FIG. 4 illustrates the apparatus illustrated in FIG. 1 operably in an initial position to straighten a nail in a piece of wood.
Figure 5:
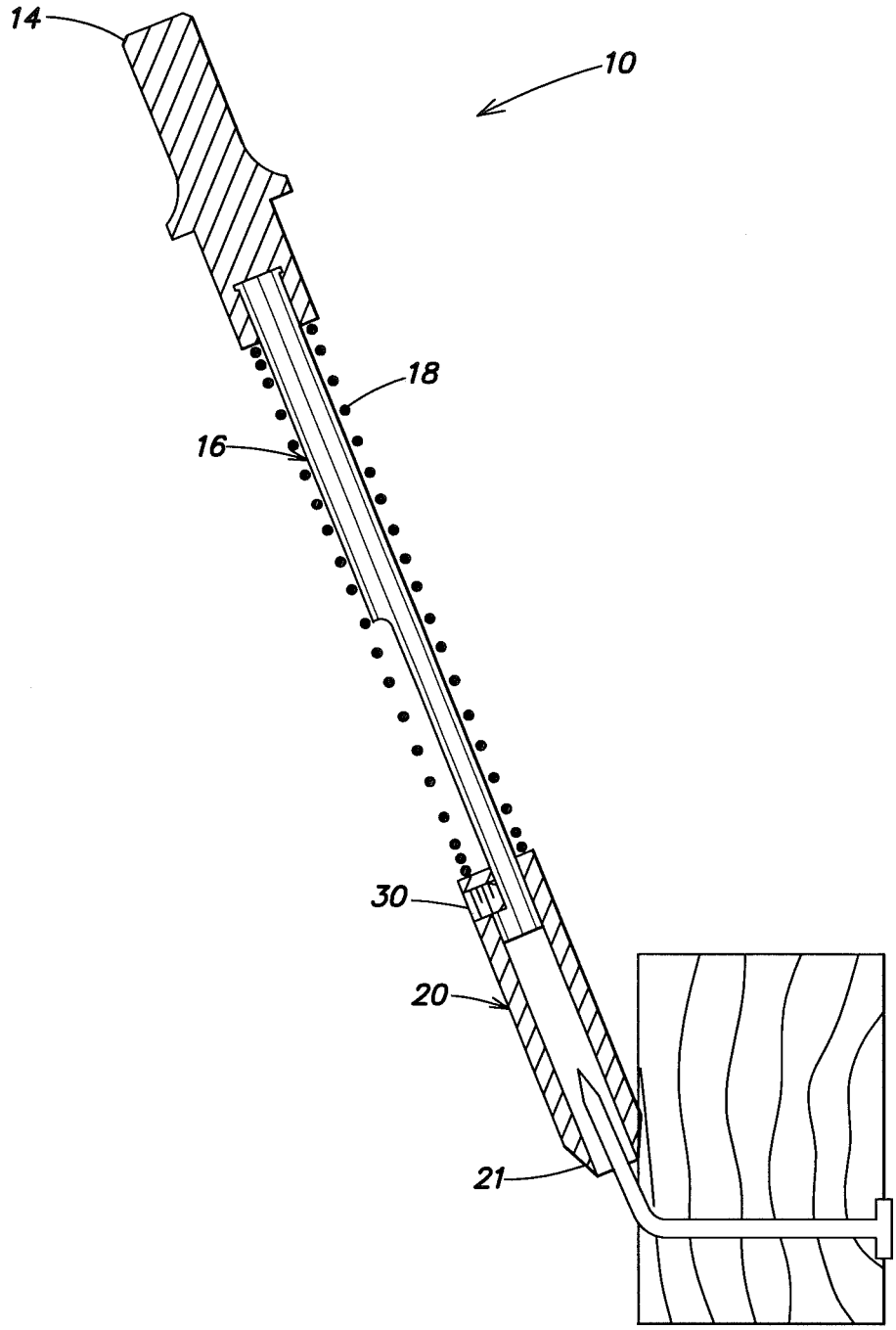
FIG. 5 illustrates the apparatus illustrated in FIG. 1 operably in a first intermediate position during straightening of the nail in the wood.
Figure 6:
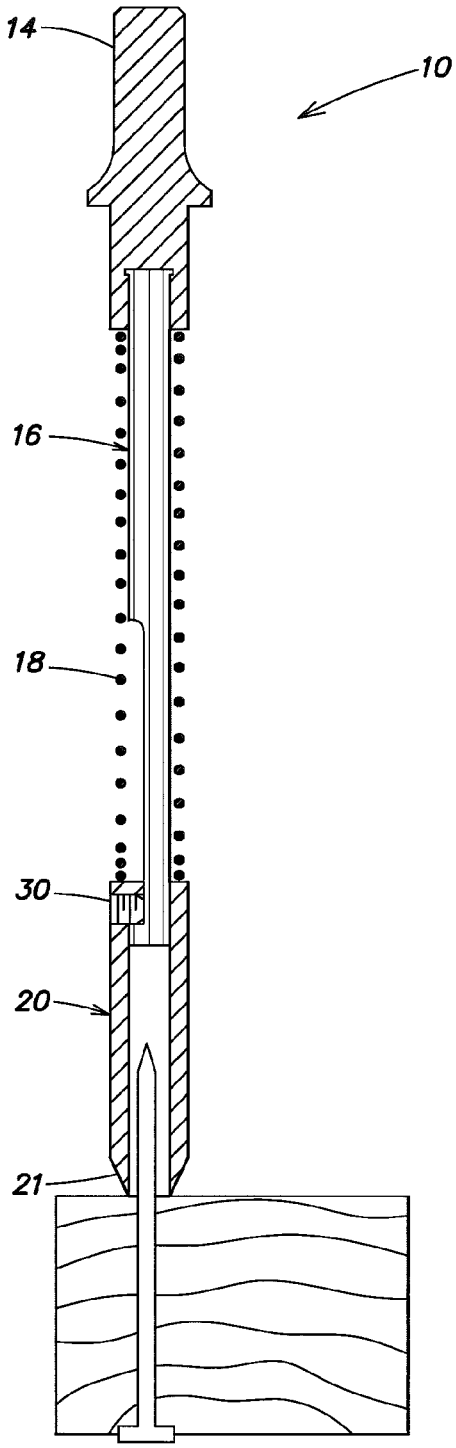
FIG. 6 illustrates the apparatus illustrated in FIG. 1 operably in a second intermediate position with the nail substantially straightened and still within the piece of wood.
Figure 7:
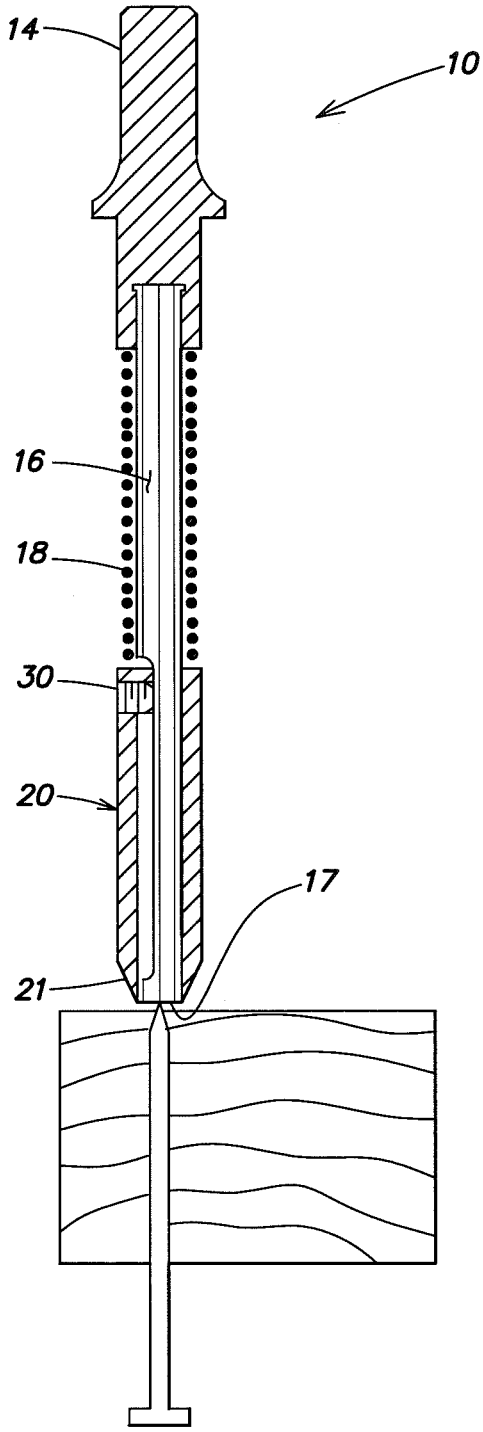
FIG. 7 illustrates the apparatus illustrated in FIG. 1 operably positioned after driving the tip of the nail substantially planar with a surface of the wood and in position to be removed from the wood via its head.
Figure 8:
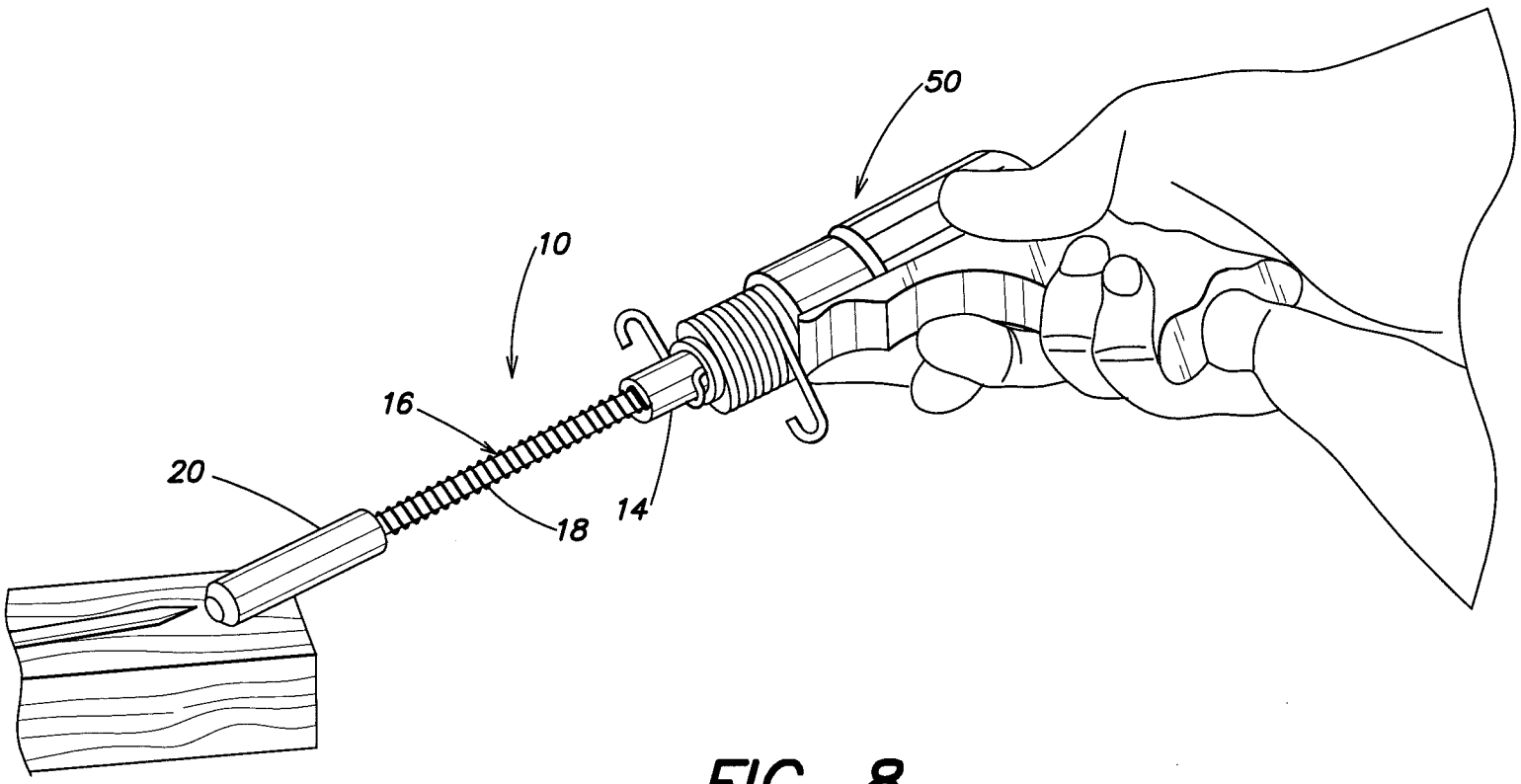
FIGS. 8-10 illustrate the apparatus of FIG. 1 operably located at various positions while attached to a pneumatic air hammer.
Figure 9:
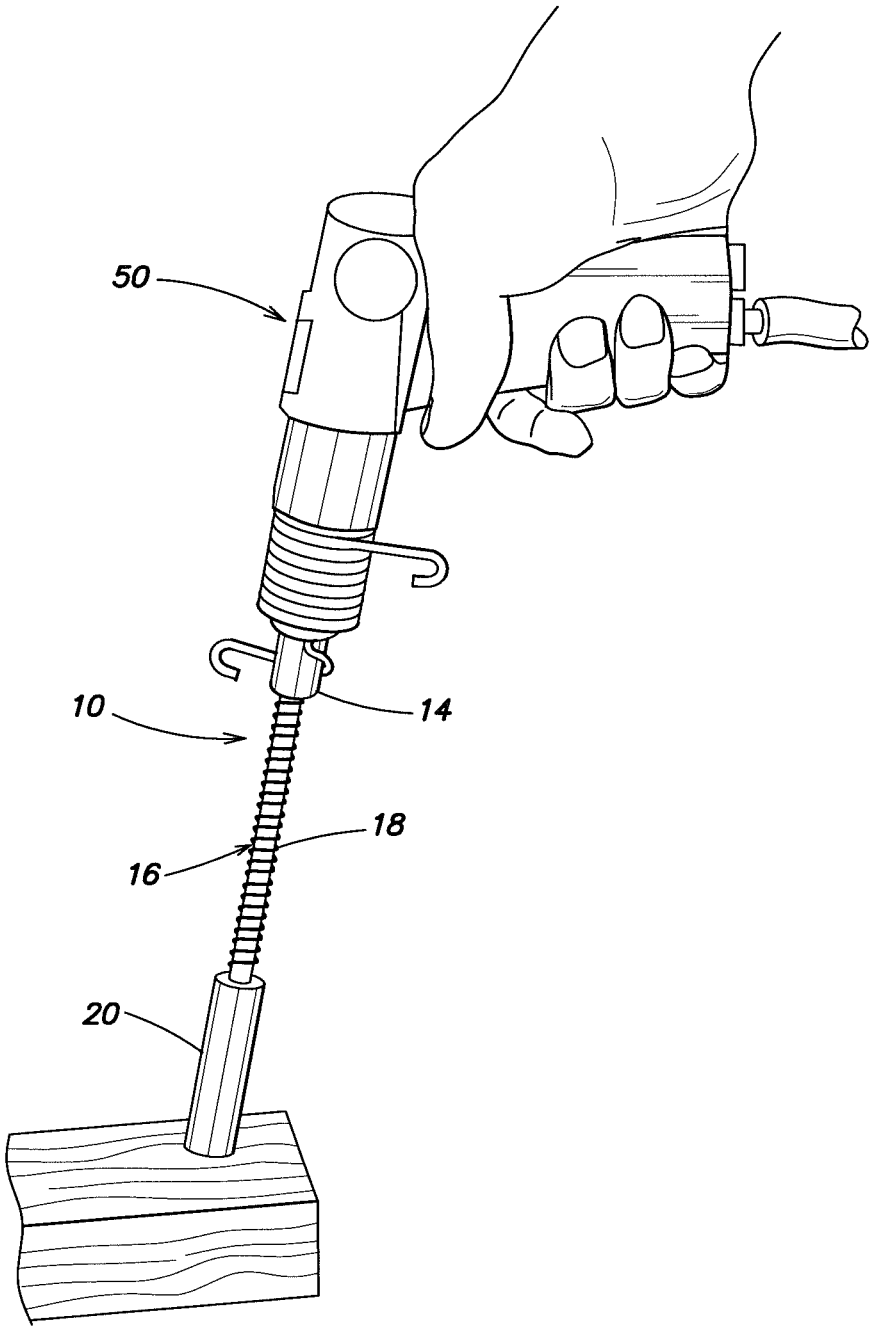
Figure 10:
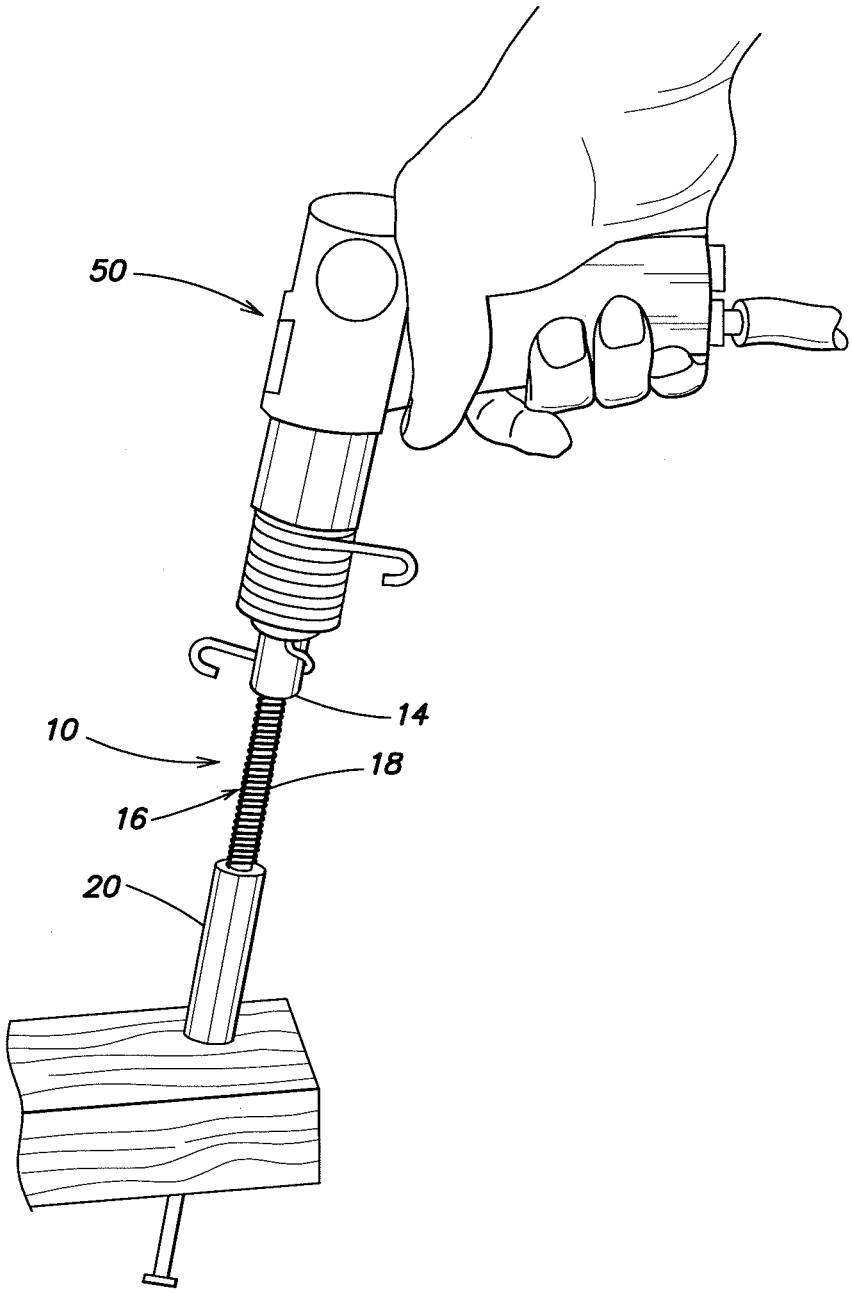

Referring to FIGS. 4-10, the apparatus 10 may be connected to a pneumatic air hammer 50 (FIGS. 8-10), so the punch 14 is repeatedly driven downwardly such that the distal end 17 of the shank 16 strikes the fastener to be removed. As an example, the present invention shall now be discussed in the context of removing a nail from wood. However, one of ordinary skill in the art will immediately appreciate that apparatus of the present invention may be used to remove fasteners other than nails (such as for example staples, screws, etc) from host material other than wood. To remove the nail, the apparatus 10 is positioned such that the distal end/tip of the nail is inserted into the hollow sleeve 20. However, if a distal end of the nail is lying against the wood as shown in FIGS. 4 and 8, then the distal end can be straighten so it is substantially in a straight line with the portion of the nail within the wood. For this reason the distal exterior radial sidewall 21 of the hollow sleeve has a tapered segment that tapers radially outwardly from the distal end of the hollow sleeve. The distal end of the nail may be dug out or knocked ajar from the surface of the wood by simultaneously applying pressure to the distal end/tip of the nail and pulsing the air hammer trigger. Once the nail tip is clear of the wood, with the sleeve 20 over the exposed length of the nail, the exposed length of the nail may be substantially straightened with leverage from the operator. Once the distal end of the nail is relatively straight, the operator may operate the air hammer to pulsate the punch 14 (FIG. 1) to drive the tip of the nail substantially flush with the surface of the wood. The apparatus 10 may be removably and replaceably be secured to the air hammer.

Figure 11:
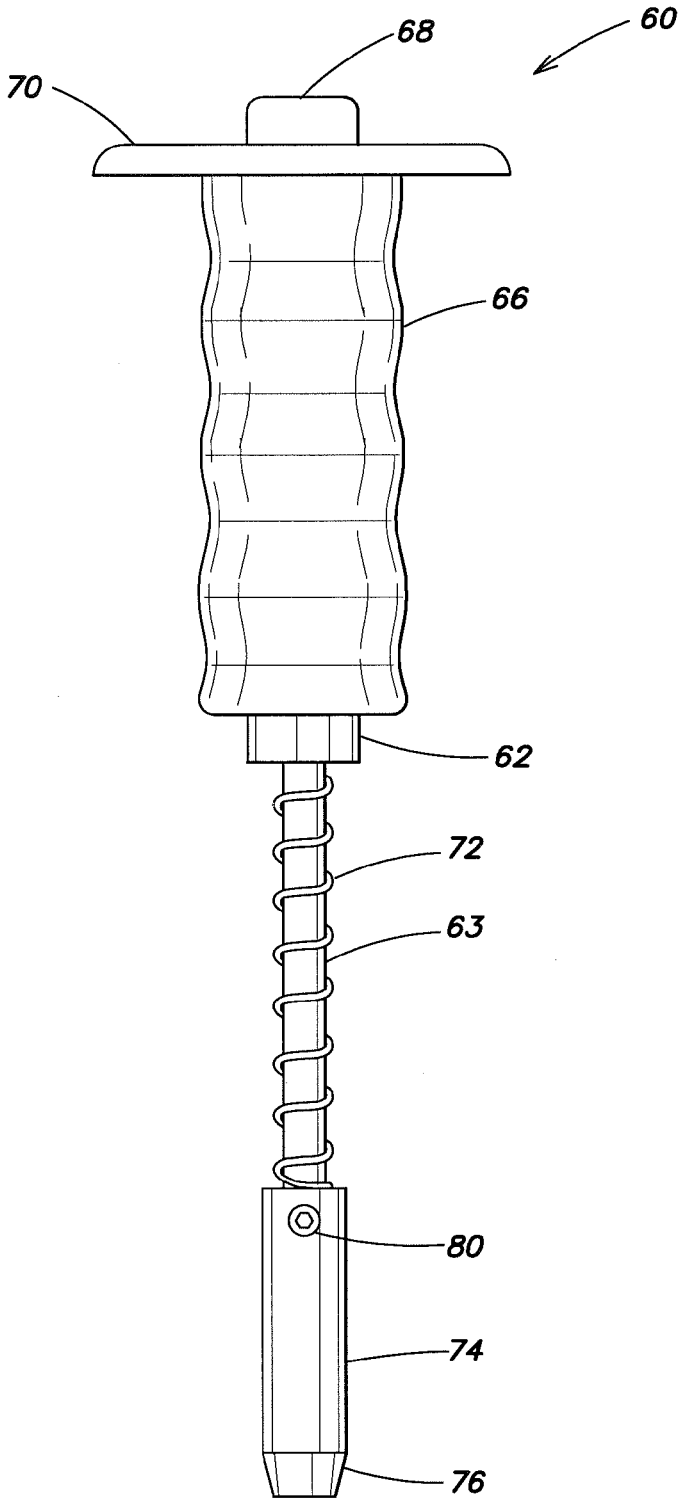
FIG. 11 is an illustration of an alternative embodiment of the apparatus configured as a hand tool.
Figure 12:
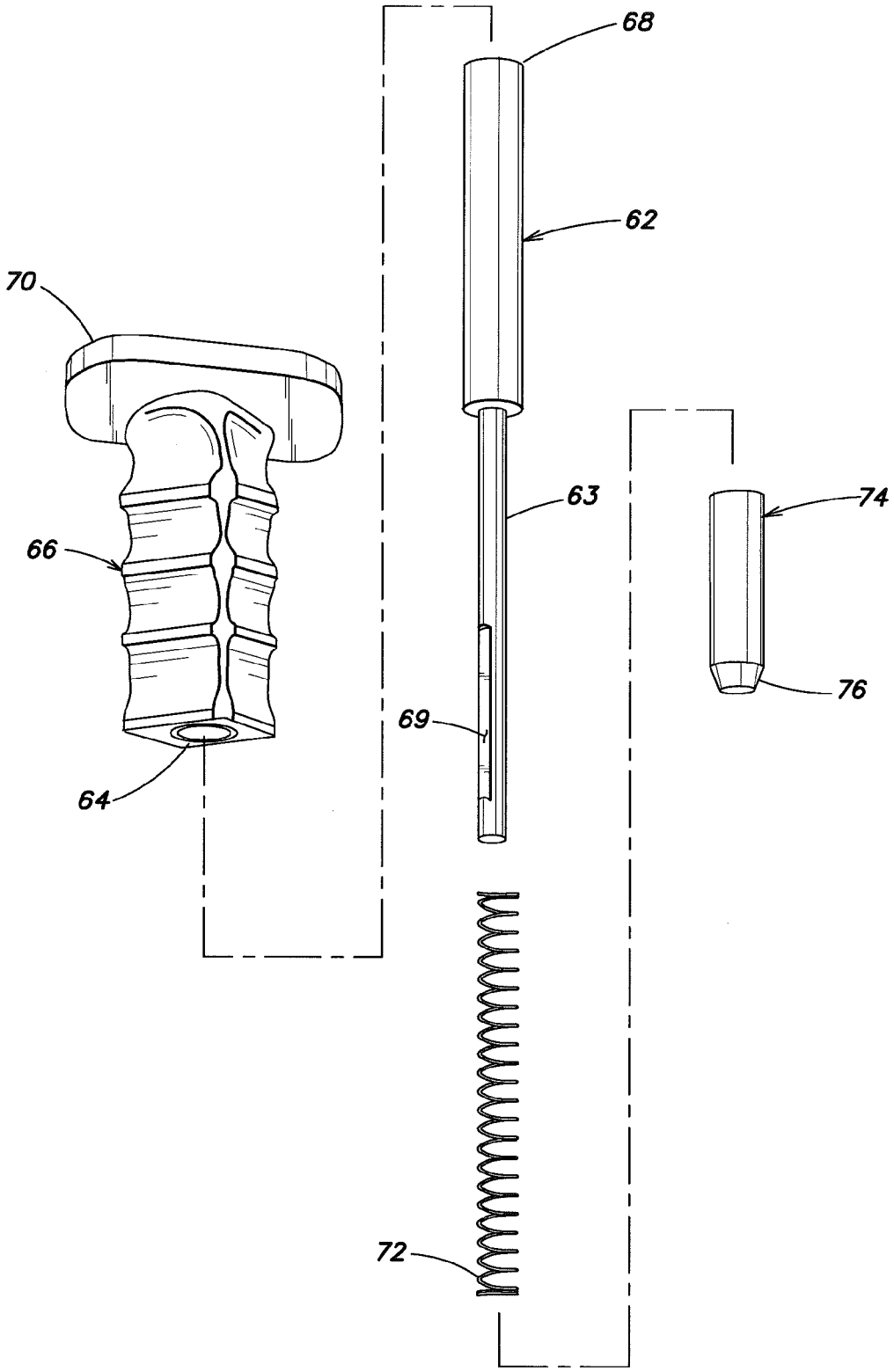
FIG. 12 is an exploded view of several components of the apparatus illustrated in FIG. 11.

FIG. 11 is an illustration of an alternative embodiment apparatus 60 configured as a hand tool. FIG. 12 is an exploded view of several components of the apparatus illustrated in FIG. 11. Referring to FIGS. 11 and 12, the alternative embodiment hand tool apparatus 60 is substantially the same as the embodiment illustrated in FIG. 1 with the principal exception that punch 62 extends through a central bore 64 of a grip 66 (e.g., rubber), and top surface 68 of the punch 62 extends from a top surface 70 of the grip. The alternative embodiment apparatus 60 also includes a compression spring 72 and a hollow sleeve 74 with a tapered distal exterior radial sidewall 76. The compression spring 72 is installed over distal end of the shank 63, and the sleeve 74 is then installed over the shank under tension while setscrew 80 is tightened into a retention flat 69 of the shank 63 to keep the sleeve 74 retained about the shank, while being able to longitudinally slide along the surface of the retention flat 69.

Figure 13:
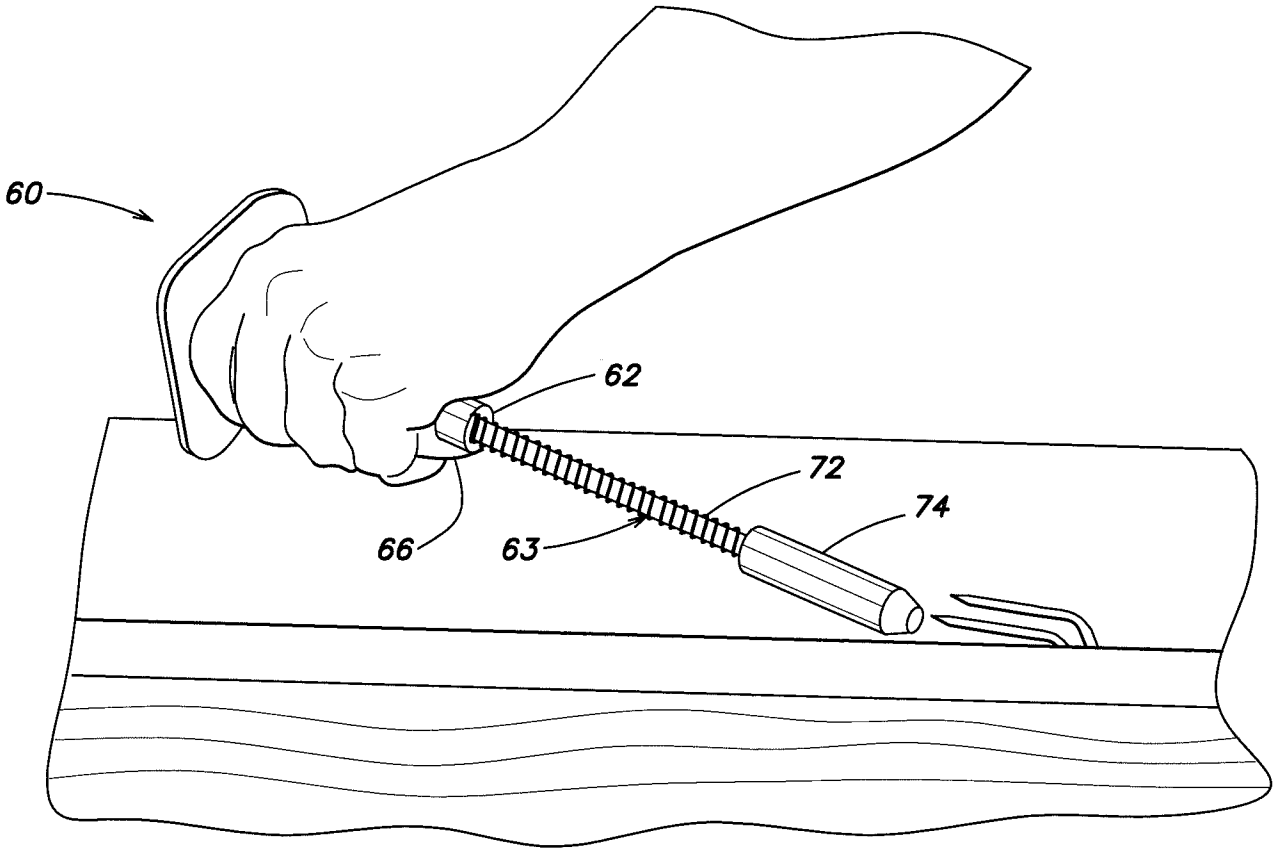
FIG. 13 illustrates the apparatus of FIG. 11 operably in an initial position to straighten a nail in a piece of wood.
Figure 14:
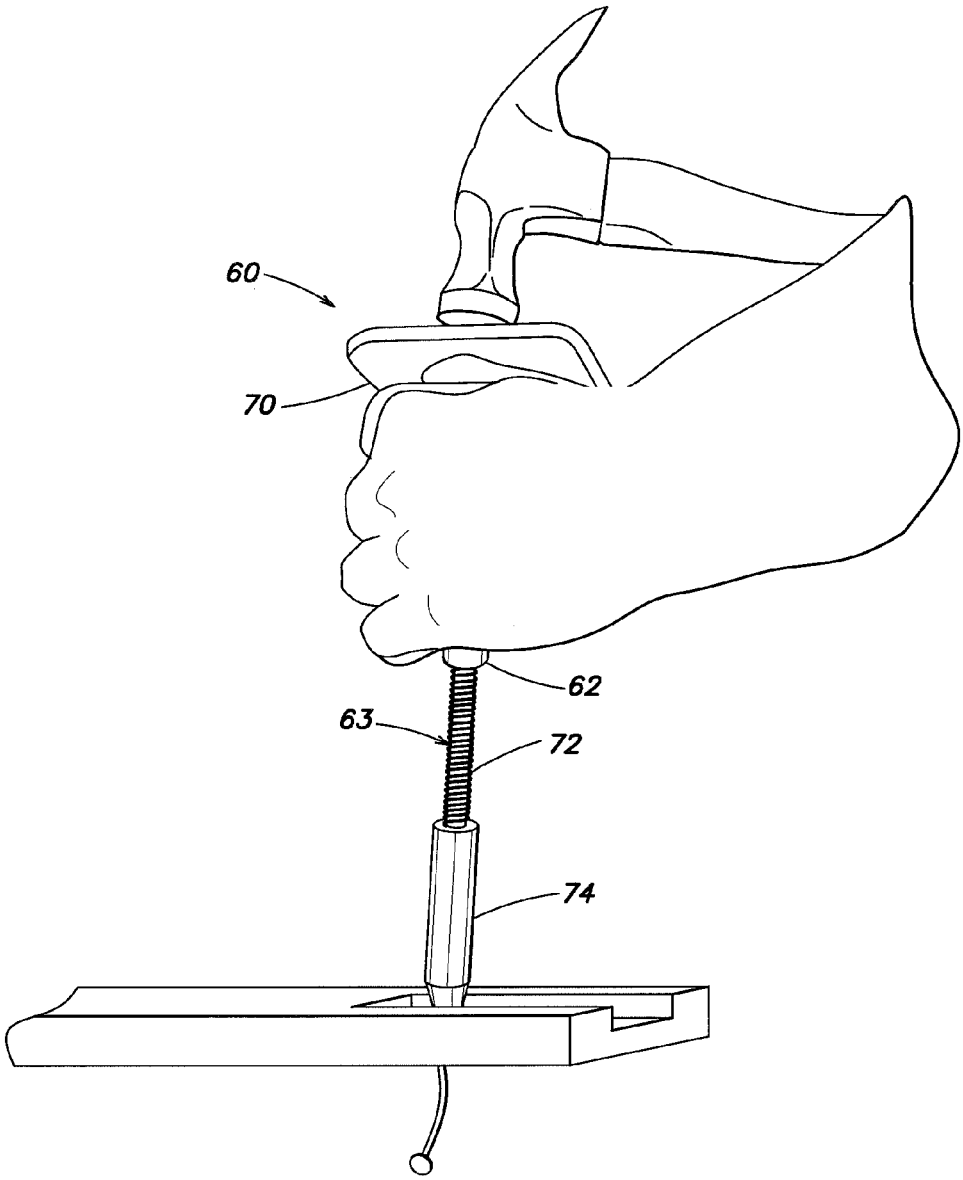
FIG. 14 illustrates the apparatus of FIG. 11 being struck by a hammer to push the nail located in the hollow sleeve through the wood.

FIG. 13 illustrates the apparatus of FIG. 11 operably in an initial position to straighten a nail in a piece of wood. FIG. 14 illustrates the top surface 70 of the punch 62 being struck by a hammer to push the nail located in the hollow sleeve 74 through the wood.

Figure 15A:
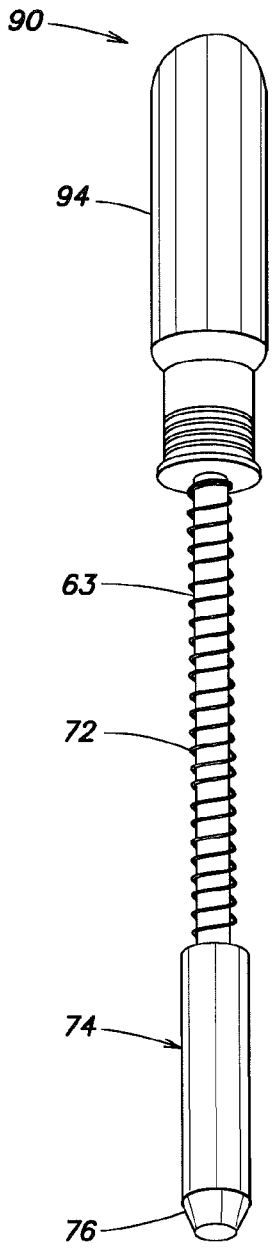
Figure 15B:
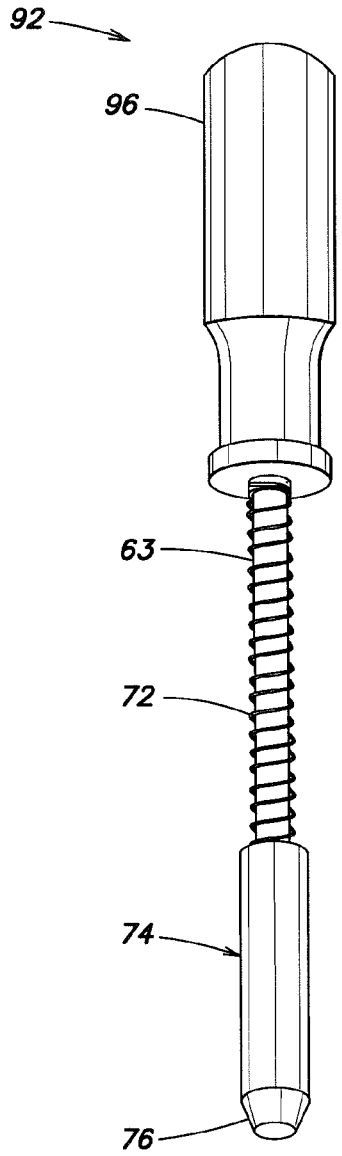
FIG. 15B illustrates another alternative embodiment for use with the strike of an open palm or force applied by the hand of the user.

FIG. 15A illustrates a first embodiment of the hand tool 90 suitable for use with the strike of an open palm or force applied by the hand of the user, while FIG. 15B illustrates another alternative embodiment 92 for use with the strike of an open palm or force applied by the hand of the user. Grips 94, 96 in FIGS. 15A and 15B respectively may both include enclosed top surfaces since the punch 62 does not have to be exposed on the top to assert a removable force against the nail.

Figure 16:
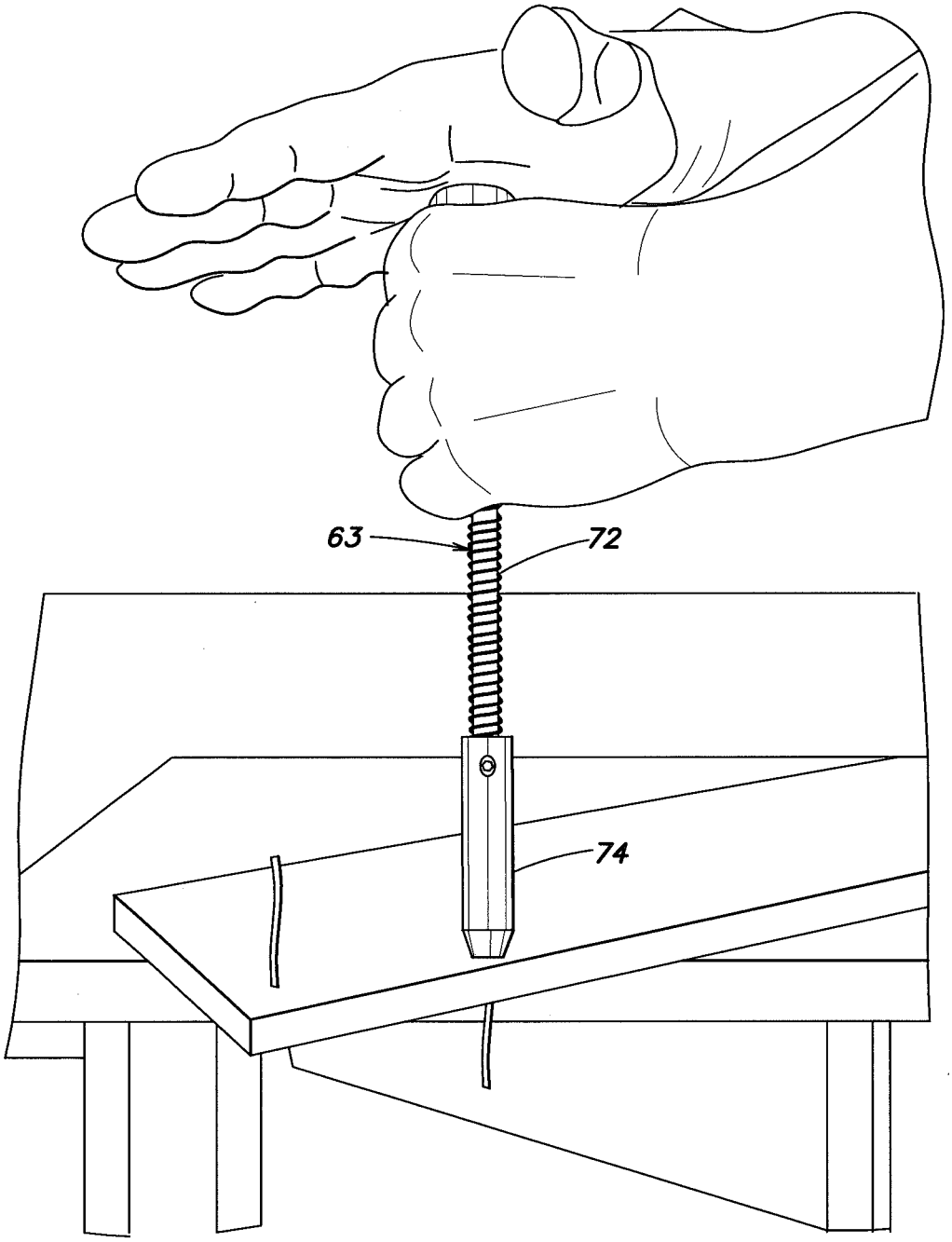
FIG. 16 illustrates the hand tool of FIG. 15A operably positioned over the tip of a nail and receiving a strike from the open hand of a user.
Figure 17:
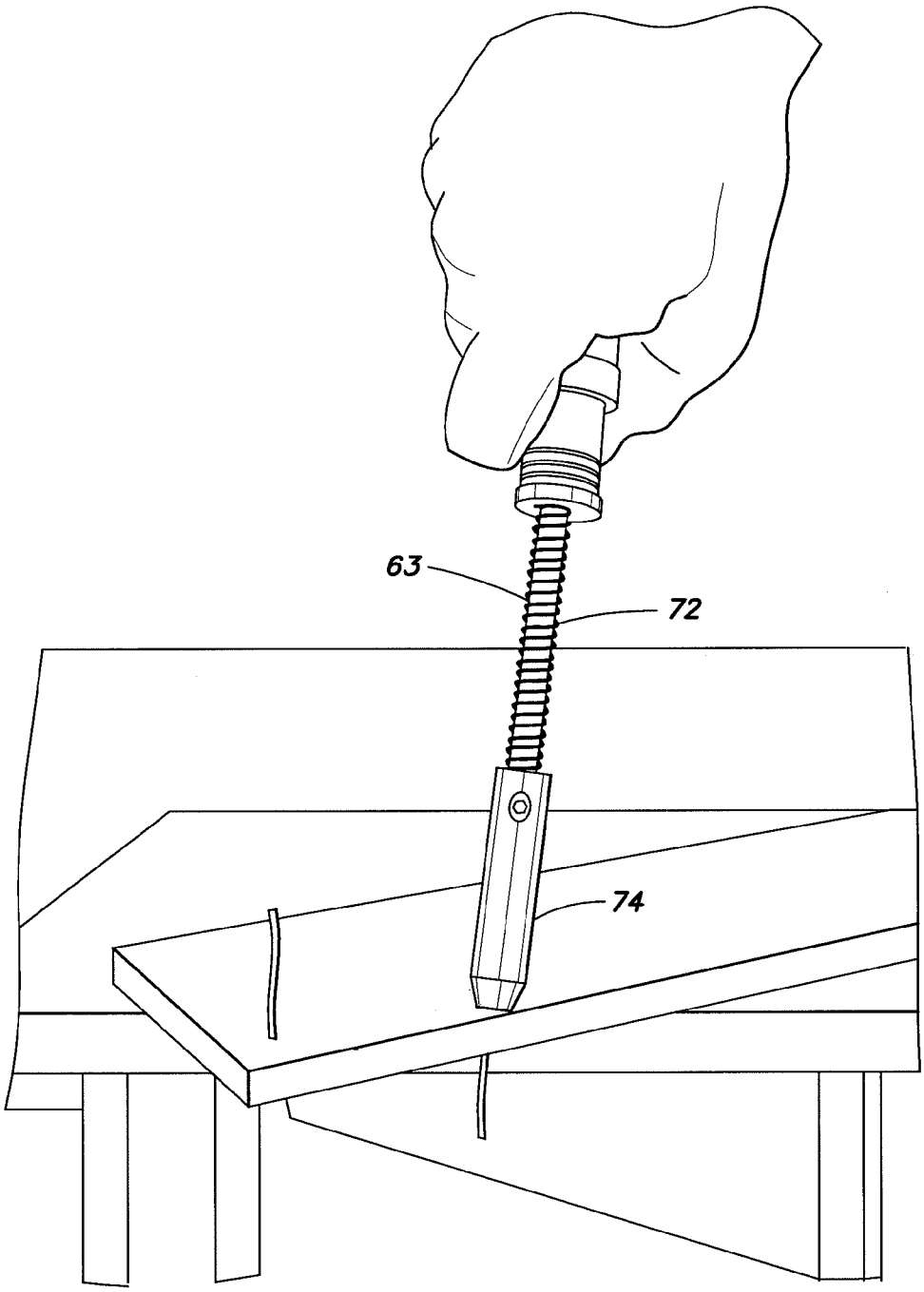
FIG. 17 illustrates the hand tool of FIG. 15A operably positioned over the tip of a nail and a force being applied to the tip of the nail by the closed hand of a user about the grip.

FIG. 16 illustrates the hand tool of FIG. 15A operably positioned over the tip of a nail and receiving a strike from the open hand of a user. FIG. 17 illustrates the hand tool of FIG. 15A operably positioned over the tip of a nail and a force being applied to the tip of the nail by the closed hand of a user via distal end (not shown) of the punch 62 within the hollow sleeve 74.

Although the present invention has been shown and described with respect to several preferred embodiments thereof, various changes, omissions and additions to the form and detail thereof, may be made therein, without departing from the spirit and scope of the invention.

What is claimed is:

1. An apparatus for pushing a fastener from a host material with an air hammer, comprising:

a shank having a distal end, a proximate end and a central portion that includes a retention flat formed therein;

a compression spring that coaxially surrounds the central portion of the shank;

a hollow sleeve having a top end and a tapered bottom end, where the sleeve includes a central recess formed therein that substantially coaxially surrounds the distal end of the shank;

a fastener that engages the hollow sleeve to position the hollow sleeve to longitudinally slide along the shank; and punch that comprises a central recess having a bottom surface that is longitudinally adjacent to and in face-to-face contact with the proximate end of the shank, where the punch comprises a top surface that operably engages with the air hammer such that pulsations from the air hammer against the top surface of the punch and thus against the compression force of the spring in response to activating the air hammer cause repeated movement of the shank through the hollow sleeve to push a fastener from the host material, wherein the hollow sleeve includes a through hole substantially perpendicular to the longitudinal axis of the shank, sized to receive the fastener.

2. An apparatus of claim 1, wherein the tapered bottom end of the hollow sleeve tapers radially outwardly from a distal bottom end of the hollow sleeve.

3. The apparatus of claim 1, wherein the through hole is threaded to receive the fastener which is complimentarily threaded.

4. A hand tool, comprising:

a shank having a distal end, a proximate end and a central portion that includes a retention flat formed therein;

a compression spring that coaxially surrounds the central portion of the shank;

a hollow sleeve having a top end and a tapered bottom end, where the sleeve includes a central recess formed therein that substantially coaxially surrounds the distal end of the shank;

a fastener that engages the hollow sleeve to position the hollow sleeve to longitudinally slide about the punch shank;

punch that comprises a central recess having a bottom surface longitudinally adjacent and in face-to-face contact with the proximate end of the shank, where the punch comprises a top surface; and a handle that surrounds the proximate end including the top surface of the punch, where force applied to the handle longitudinally in a direction of the hollow sleeve causes the distal end of the shank to push a fastener within the hollow sleeve from a host material, wherein the hollow sleeve includes a through hole substantially perpendicular to the longitudinal axis of the shank, sized to receive the fastener.

5. The hand tool of claim 4, wherein the tapered bottom end of the hollow sleeve tapers radially outwardly from a distal bottom end of the hollow sleeve.

6. The hand tool claim 4, wherein the through hole is threaded to receive the fastener which is complimentarily threaded.

* * * * *